United States Patent [19]

Kalina

[11] Patent Number: 4,899,545

[45] **Date of Patent: * Feb. 13, 1990**

[54] METHOD AND APPARATUS FOR THERMODYNAMIC CYCLE

[76] Inventor: Alexander I. Kalina, 105 Glen Garry Way, Hillsborough, Calif. 94010

[ * ] Notice: The portion of the term of this patent subsequent to Mar. 22, 2005 has been disclaimed.

[21] Appl. No.: 295,787

[22] Filed: Jan. 11, 1989

[51] Int. Cl.[4] ..... F01K 25/06

[52] U.S. Cl. ..... 60/673; 60/649

[58] Field of Search ..... 60/649, 673

[56] References Cited

U.S. PATENT DOCUMENTS 4,548,043 10/1985 Kalina ..... 60/673

4,732,005 3/1988 Kalina ..... 60/673

*Primary Examiner*—Allen M. Ostrager

*Attorney, Agent, or Firm*—Arnold, White & Durkee

[57] ABSTRACT

A method and apparatus for implementing a thermodynamic cycle, which includes the use of a composite stream, having a higher content of a high-boiling component than a working stream, to provide heat needed to partially evaporate the working stream. After being partially evaporated, the working stream is evaporated completely with heat provided by returning gaseous working streams and heat from an auxiliary steam cycle. After being superheated, the working stream is expanded in a turbine. Thereafter, the expanded stream is separated into a spent stream and a withdrawal stream. The withdrawal stream is combined with a lean stream to produce the composite stream. The composite stream partially evaporates the working stream and preheats the working stream and the lean stream. A first portion of the composite stream is fed into a distillation tower. A liquid stream flowing from the distillation tower forms the lean stream that is combined with the withdrawal stream. A vapor stream flowing from the distillation tower combines with a second portion of the composite stream to produce a pre-condensed working stream that is condensed forming a liquid working stream. The cycle is complete when the liquid working stream is preheated prior to being partially evaporated.

31 Claims, 1 Drawing Sheet

METHOD AND APPARATUS FOR THERMODYNAMIC CYCLE

BACKGROUND OF THE INVENTION

This invention relates generally to methods and apparatus for transforming thermal energy from a heat source into mechanical and then electrical form using a working fluid that is expanded and regenerated. This invention further relates to a method and apparatus for improving the thermal efficiency of a thermodynamic cycle.

2. Brief Description of the Background Art

U.S. Pat. No. 4,732,005 describes a thermodynamic cycle that includes a working fluid that is a mixture of at least two components. As described in that patent, such a multi-component working fluid may enable a large percentage of recuperative heat exchange to be achieved, including recuperative preheating, recuperative boiling and partial recuperative superheating.

Such recuperative boiling, although apparently impossible in a single component system, may be possible in the multi-component working fluid cycle described in that patent. That cycle provides lower temperature heat for evaporation, which may substantially reduce thermodynamic losses resulting from evaporation. Reducing those losses can substantially increase the efficiency of the system. U.S. Pat. No. 4,732,005 is expressly incorporated by reference herein.

SUMMARY OF THE INVENTION

In the system of the present invention, heat from an external heat source is used to complete the evaporation of a multicomponent working stream that has been partially evaporated by heat transferred from a counterstream of a composite stream that includes a higher percentage of a high boiling component than is contained in the working stream.

In accordance with one embodiment of the present invention, a method of implementing a thermodynamic cycle includes the step of expanding a gaseous working stream to transform its energy into a usable form. The expanded gaseous working stream is divided into a withdrawal stream and a spent stream. After dividing the expanded stream into the two streams, the withdrawal stream is combined with a lean stream, having a higher content of a high-boiling component than is contained in the withdrawal stream, to form a composite stream that condenses over a temperature range that is higher than the temperature range required to evaporate an oncoming liquid working stream.

After forming the composite stream, that stream is transported to a boiler where it is condensed to provide heat for the partial evaporation of the oncoming liquid working stream. An external heat source is used to completely evaporate the liquid working stream. Evaporation of the liquid working stream produces the above mentioned gaseous working stream. Subsequently, the composite stream is separated to form a liquid stream and a vapor stream. Some or all of the liquid stream forms the above mentioned lean stream. The vapor stream is returned into the cycle, preferably by being combined with a portion of the composite stream to produce a pre-condensed working stream. The pre-condensed working stream is condensed to produce the liquid working stream that is transported to the boiler. The spent stream may be combined with the composite stream. Alternatively, the spent stream may be returned to the system at some other location. To complete the cycle, the heat that the above mentioned composite stream and external heat source transport to the boiler, is used to evaporate the liquid working stream to form the gaseous working stream.

In accordance with another embodiment of the present invention, the gaseous working stream, exiting from the boiler, may then be superheated in one or more heat exchangers by either the withdrawal stream or the spent stream or by both the withdrawal and spent streams. The external heat source may also be used to superheat the gaseous working stream. Following the superheating of the gaseous working stream in the heat exchangers, the gaseous working stream may be further superheated in a heater. The energy supplied to the heater is supplied from outside the thermodynamic cycle. After this superheating, expansion of the gaseous working stream takes place. This expanded gaseous working stream may be reheated and expanded one or more times before being divided into the spent and withdrawal streams. This embodiment may further include the step of reheating and expanding the spent stream one or more times after the spent stream has been separated from the withdrawal stream.

In addition, this embodiment may further include a series of recuperative heat exchangers used to recuperate heat from the withdrawal, composite, and spent streams. These heat exchangers may allow the lean stream and the liquid working stream to absorb heat from the composite stream. Further, one or more of these heat exchangers may allow the spent and withdrawal streams to provide additional heat to the liquid working stream to aid in the evaporation of the liquid working stream.

In accordance with yet another embodiment of the present invention, the methods for implementing a thermodynamic cycle described above may further include the step of reducing the pressure of the composite stream with a hydraulic turbine (or alternatively a throttle valve). After this reduction of pressure, a first portion of this composite stream may be sent to a separator where it is separated into a vapor stream and a liquid stream.

In this embodiment, the liquid stream may form all or a portion of the lean stream which may be sent to a circulation pump to be pumped to a higher pressure. The circulation pump may be connected to the hydraulic turbine; the hydraulic turbine releasing energy used to operate the pump. After attaining this high pressure, the lean stream may be heated by the returning composite and spent streams in one or more heat exchangers. After acquiring this additional heat, the lean stream is combined with the withdrawal stream to form the composite stream used to preheat and partially evaporate the liquid working stream.

The vapor stream may be combined with a second portion of the composite stream, that flows from the hydraulic turbine, to form a pre-condensed working stream. This stream may then pass through a heat exchanger, to supply heat to the returning liquid working stream, before it is fed into a water-cooled condenser to be fully condensed to produce the liquid working stream.

The liquid working stream may be pumped to a high pressure by a feed pump. After obtaining this high pressure, the liquid working stream may be heated in a series of heat exchangers by the pre-condensed working stream and the returning composite stream. This heat exchange continues until the liquid working stream is partially evaporated. In this embodiment, the partially evaporated working stream may be completely evaporated by heat from the external heat source and from the returning withdrawal and spent streams to produce the gaseous working stream, thereby completing the cycle.

DESCRIPTION OF A PREFERRED EMBODIMENT

Figure 1:
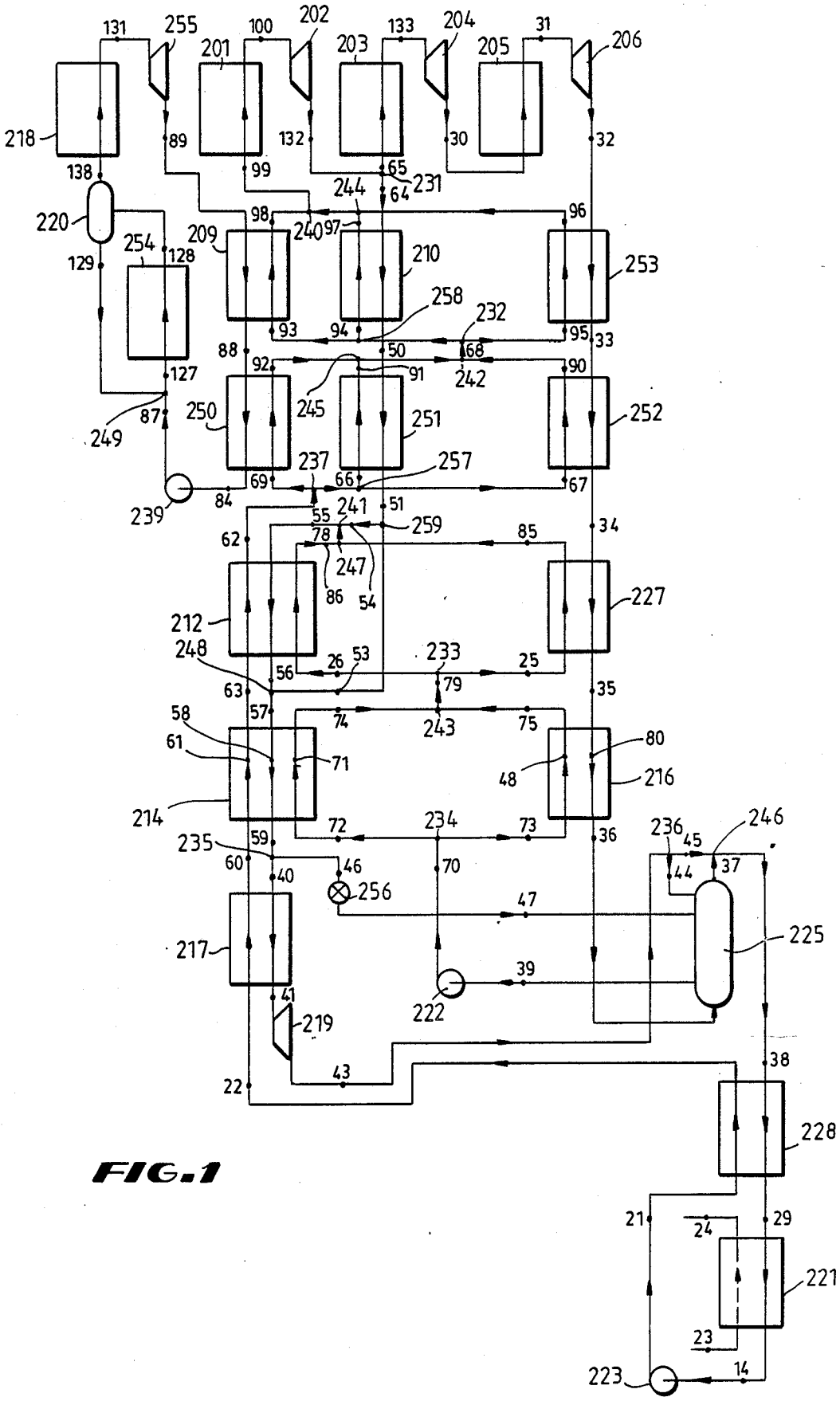
FIG. 1 is a schematic representation of one embodiment of the method and apparatus of the present invention.

The schematic shown in FIG. 1 shows an embodiment of preferred apparatus that may be used in the above described cycle. Specifically, FIG. 1 shows a system 200 that includes a boiler in the form of heat exchangers 212, 250, 251, and 252, a preheater in the form of heat exchangers 214, 216, and 227, and a superheater in the form of heat exchangers 209, 210, and 253. In addition, the system 200 includes turbines 202, 204, 206, and 255, superheaters 201 and 218, reheaters 203 and 205, gravity separator 220, distillation tower 225, hydraulic turbine 219, pumps 222, 223, and 239, heat exchangers 217 and 228, boiler 254, throttle valve 256, and condenser 221. Further, the system 200 includes stream separators 231–237 and 257–259 and stream mixers 240–249.

The condenser 221 may be any type of known heat rejection device. For example, the condenser 221 may take the form of a heat exchanger, such as a water cooled system, or another type of condensing device. In the alternative, condenser 221 may be replaced with the heat rejection system described in U.S. Pat. Nos. 4,489,563 and 4,604,867 to Kalina. The Kalina system requires that the stream shown approaching condenser 221 in FIG. 1 be mixed with a multi-component fluid stream, for example, a fluid stream comprised of water and ammonia, condensed and then distilled to produce the original state of the working fluid. Thus, when the heat rejection system of the Kalina cycle is used in place of condenser 221, the distillation subsystem described in U.S. Pat. Nos. 4,489,563 and 4,604,867 may be utilized in place of condenser 221. U.S. Pat. Nos. 4,489,563 and 4,604,867 are expressly incorporated by reference herein.

Various types of heat sources may be used to drive the cycle of this invention. Thus, for example, heat sources with temperatures as high as 1,000° C. or more down to heat sources sufficient to superheat a gaseous working stream may be used to heat the gaseous working stream flowing through heater 201 and reheaters 203 and 205 and the auxiliary gaseous working stream flowing through heater 218, described below. Preferred heat sources are those generated by the combustion of fossil fuels in preheated air. (Combustion gases, which are cooled to a temperature of about 750° F., may be further used to preheat oncoming air, enabling heat released at a temperature near 750° F. to be usable for that purpose). Any other heat source capable of superheating the gaseous working stream that is used in the described embodiment of the invention may also be used.

The working fluid used in the system 200 may be any multi-component working fluid that comprises a lower boiling point fluid and a relatively higher boiling point fluid. Thus, for example, the working fluid employed may be an ammonia-water mixture, two or more hydrocarbons, two or more freons, mixtures of hydrocarbons and freons, or the like. In general, the fluid may be mixtures of any number of compounds with favorable thermodynamic characteristics and solubility. In a preferred embodiment, a mixture of water and ammonia is used.

As shown in FIG. 1, a working stream circulates through system 200. The working stream includes a gaseous working stream that flows from stream mixer 242 until it is separated into a withdrawal stream and a spent stream at separator 231. In addition to the gaseous working stream, the withdrawal stream (that flows from separator 231 to stream separator 259) and the spent stream (that flows from separator 231 to distillation tower 225) the working stream includes a first withdrawal stream (that flows from stream separator 259 to stream mixer 241), a second withdrawal stream (that flows from stream separator 259 to stream mixer 248), a pre-condensed working stream (that flows from mixer 246 to condenser 221) and a liquid working stream (that flows from condenser 221 to boilers 212, 250, 251, and 252). Each portion of the working stream contains the same percentage of high boiling and low boiling components.

In the embodiment of FIG. 1, the gaseous working stream with parameters as at point 99, that has been completely evaporated and superheated in previous stages of system 200, enters heater 201. While in heater 201, the gaseous working stream is superheated by an external heat source to the highest temperature that is reached at any stage in the process obtaining parameters as at point 100. After being superheated, this gaseous working stream is expanded in high pressure turbine 202 to an intermediate pressure, producing work, and obtaining parameters as at point 132.

After expansion in turbine 202, the gaseous working stream is separated by separator 231 into two streams, a withdrawal stream and a spent stream, with parameters as at points 64 and 65, respectively. The spent stream is reheated in reheater 203, obtaining parameters as at point 133, and expanded in intermediate pressure turbine 204, producing work, and obtaining parameters as at point 30. The spent stream is then reheated a second time in heater 205 obtaining parameters as at point 31, and expanded a second time in low pressure turbine 206, obtaining parameters as at point 32.

Although FIG. 1 shows the system 200 as having two reheaters 203 and 205, for reheating the spent stream, and two turbines 204 and 206, for expanding the spent stream, the optimum number of reheaters and turbines depends upon the desired efficiency of the system. The number of reheaters and turbines may be either increased or decreased from the number shown in FIG. 1. In addition, a single heater may be used to heat the gaseous working stream, prior to expansion, and the spent working stream, prior to the expansion of the spent stream. Therefore, the number of heaters and reheaters may be more than, less than, or equal to the number of turbines.

Further, system 200 may include additional heaters and turbines for reheating and expanding the gaseous stream exiting from turbine 202 prior to that stream's separation into the withdrawal and spent streams. Thus, although the inclusion of reheaters 203 and 205 and turbines 204 and 206 to system 200 provides a preferred embodiment of the present invention, one may select a different number of reheaters and turbines without departing from the scope of the disclosed general inventive concept.

After the above described reheatings and expansions of the spent stream, the stream passes through a series of recuperative heat exchangers. As shown in FIG. 1, the spent stream, after expansion, passes through recuperative heat exchangers 253, 252, 227 and 216. While passing through heat exchanger 253, the spent stream provides heat to superheat the gaseous working stream flowing from point 95 to point 96. The spent stream obtains parameters as at point 33 after it exits from heat exchanger 253. While passing through heat exchanger 252, the spent stream provides heat to completely evaporate an oncoming partially evaporated high-pressure liquid working stream flowing from point 67 to point 90. The spent stream obtains parameters as at point 34 after it exits from heat exchanger 252. Similarly, while passing through heat exchangers 227 and 216, the spent stream provides heat to preheat a lean stream flowing from point 25 to point 85, and from point 73 to point 75, respectively. The spent stream obtains parameters as at point 35, after it exits from heat exchanger 227, and parameters as at point 36, after it exits from heat exchanger 216.

Whether any or all of the heat exchangers 227, 252, 253, and 216 are used or whether a number of additional heat exchangers are added to the system is a matter of design choice. Although the inclusion of heat exchangers 252, 253, 227, and 216 to system 200 is preferred, the spent stream may pass through an increased number of heat exchangers, or not pass through any heat exchangers at all, without departing from the scope of the disclosed invention.

The withdrawal stream beginning at stream separator 231 initially passes through recuperative heat exchanger 210. While passing through heat exchanger 210, the withdrawal stream provides heat for the superheating of the oncoming high-pressure gaseous working stream flowing from point 94 to point 97. The withdrawal stream obtains parameters as at point 50 after it exits from heat exchanger 210.

The withdrawal stream then passes through heat exchanger 251, where it provides heat to completely evaporate an oncoming partially evaporated high-pressure liquid working stream flowing from point 66 to point 91. The withdrawal stream obtains parameters as at point 51 after it exits from heat exchanger 251. Although system 200 preferably includes heat exchangers 210 and 251, one may remove heat exchanges 210 and 251 or add additional heat exchangers.

After the withdrawal stream exits from heat exchanger 251, it is divided at stream separator 259 into a first withdrawal stream (that passes from stream separator 259 to stream mixer 241) and a second withdrawal stream (that passes from stream separator 259 to stream mixer 248). The first and second withdrawal streams have parameters as at points 54 and 53, respectively. The temperature of the streams flowing past points 51, 53, and 54 is higher than the temperature of the stream flowing past point 62. The preferred state of the streams flowing past points 51, 53, and 54 is that of a superheated vapor.

The first withdrawal stream combines with a lean stream, having parameters as at point 78, at stream mixer 241. That lean stream contains the same components as are contained in the working stream. The lean stream, however, contains a higher content of a high-boiling component than is contained in any part of the working stream. For example, if ammonia and water are the two components present in the working and lean streams, the water is the high-boiling component and the ammonia is the low-boiling component. In such two component system, the lean stream contains a higher percentage of water than is contained in the working stream. As shown in FIG. 1, the lean stream flows from distillation tower 225 to stream mixer 241.

In this embodiment, the state of the lean stream at point 78, prior to mixing with the first withdrawal stream at stream mixer 241, is preferably that of a subcooled liquid.

Mixing the lean stream with the first withdrawal stream at stream mixer 241 provides a composite stream having parameters as at point 55. That composite stream has a lower boiling temperature range than the lean stream but a higher boiling temperature range than the first withdrawal stream or any other portion of the working stream. The state of the composite stream as it flows from stream mixer 241 depends upon the states of the lean and first withdrawal streams. It is preferably that of a vapor-liquid mixture. Preferably, the pressure of the first withdrawal stream at point 54 and the lean stream at point 78, prior to mixing at stream mixer 241, will be the same as the pressure of the composite stream at point 55, that is formed at stream mixer 241. The temperature of the composite stream at point 55 is preferably higher than the temperature of the lean stream at point 78 and slightly lower than the temperature of the first withdrawal stream at point 54.

The composite stream will contain a higher percentage of a high-boiling component than is contained in the withdrawal stream or in other portions of the working stream. Because the composite stream contains a higher percentage of a high-boiling component, it may be condensed within a temperature range which exceeds the boiling temperature range of the liquid working stream.

For the composite stream to partially evaporate the liquid working stream flowing from point 63 to point 62, conditions for combining the first withdrawal stream and the lean stream at stream mixer 241 should be chosen so that the temperature of the composite stream at point 55 is higher than the temperature of the partially evaporated working stream at point 62.

The composite stream produced by the mixing of the first withdrawal stream with the lean stream flows into heat exchanger 212, where it is cooled and partially condensed. As it is being cooled and condensed, the composite stream provides heat to partially evaporate the oncoming liquid working stream flowing from point 63 to point 62 and to provide heat to the oncoming lean stream flowing from point 26 to point 86. The composite stream obtains parameters as at point 56 after it exits from heat exchanger 212. Thereafter, the composite stream is combined with the second withdrawal stream at stream mixer 248, creating a second composite stream having parameters as at point 57. The temperature of the composite stream at point 56 preferably is the same as the temperature of the second composite stream at point 57.

The withdrawal stream with parameters as at point 51 is thus combined with the lean stream in two steps. First, the lean stream having parameters as at point 78 is combined with the first withdrawal stream, having parameters as at point 54, to form the composite stream. The second withdrawal stream is then combined with the composite stream to create a second composite stream.

After being created at stream mixer 248, the second composite stream is sent into heat exchanger 214 to provide heat for preheating the lean stream flowing from point 72 to point 74 and the liquid working stream flowing from point 60 through point 61 to point 63. As the second composite stream transfers heat to the lean stream and the liquid working stream, the second composite stream is completely condensed and supercooled obtaining parameters as at point 59.

Again, although limiting the number of heat exchangers in this part o system 200 to heat exchangers 212 and 214 is preferred, additional heat exchangers may be added or heat exchanger 214 may be removed from the system 200 without departing from the scope of the disclosed invention.

After the second composite stream exits from heat exchanger 214, it is divided at stream separator 235 into a third composite stream and a fourth composite stream having parameters as at points 46 and 40, respectively. The fourth composite stream preferably includes the bulk of the second composite stream. The fourth composite stream is sent into heat exchanger 217, where its heat is used to preheat the liquid working stream.

Even after exiting heat exchanger 217, the pressure of the fourth composite stream at point 41, in this embodiment of the present invention, remains relatively high. Accordingly, the pressure of the fourth composite stream is reduced by passing it through hydraulic turbine 219. A particularly preferred hydraulic turbine that may be used is a Pelton wheel. The fourth composite stream obtains parameters as at point 43 after it exits hydraulic turbine 219, which preferably correspond to a state of a saturated liquid.

During this pressure reduction step, all or part of the work needed to pump the lean solution at pump 222 may be recovered. Because the weight flow rate of the stream passing through hydraulic turbine 219 is higher than the weight flow rate of the lean stream passing through pump 222, the energy released in hydraulic turbine 219 should usually be sufficient to provide the work of pump 222. If the energy that hydraulic turbine 219 releases is insufficient, a supplementary electrical motor can be installed to supply the additional power that pump 222 requires.

A throttle valve may be used as an alternative to hydraulic turbine 219. If a throttle valve is used instead of the hydraulic turbine, work spent to pump the lean solution will, of course, not be recovered. Regardless of whether hydraulic turbine 219 or a throttle valve is used, however, the remainder of the process will not be affected. The choice of whether to use a hydraulic turbine or a throttle valve to reduce the pressure of the fourth composite stream is strictly an economic one. Further, although the use of heat exchanger 217 and turbine 219 is preferred, one may decide not to use these devices, or may decide to add additional heat exchangers or other pressure reduction apparatus to the system 200.

After exiting from hydraulic turbine 219, the fourth composite stream is separated at stream separator 236 into first and second liquid streams having parameters as at points 44 and 45, respectively. The first liquid stream, in this embodiment of the present invention, is sent into the top of distillation tower 225. As is shown in FIG. 1, the spent stream, having parameters as at point 36, is sent into the bottom of distillation tower 225.

The third composite stream, after having passed through throttle valve 256, obtaining parameters as at point 47, is sent into the middle section of distillation tower 225.

The distillation process takes place via direct contact heat and mass exchange in distillation tower 225. That direct exchange enables the pressure at point 36 to be significantly decreased—enabling increased expansion work at turbine 206.

A stream of enriched vapor, with parameters as at point 37, exists from the top of distillation tower 225. The stream forming the above described lean stream (that is combined with the first withdrawal stream to form the composite stream), with parameters as at point 39, exits from the bottom of distillation tower 225. The vapor stream is combined at stream mixer 246 with the second liquid stream, with parameters as at point 45, creating a pre-condensed working stream having parameters as at point 38. The state of the pre-condensed working stream at point 38 preferably corresponds to that of a vapor-liquid mixture.

The pre-condensed working stream passes through recuperative heat exchanger 228 where it is cooled and partially condensed, obtaining parameters as at point 29. The pre-condensed working stream then enters condenser 221, where it is completely condensed to form a liquid working stream, having parameters as at point 14.

Condenser 221 may be cooled by water or air (represented by the stream flowing from point 23 to point 24). The liquid working stream flowing from point 14 is pumped by pump 223 to high pressure, obtaining parameters as at point 21. Thereafter, this high pressure liquid working stream passes through heat exchanger 228 where it is heated, obtaining parameters as at point 22. The high pressure liquid working stream then passes through heat exchanger 217 where it is further preheated and obtains parameters as at point 60.

In the embodiment of the present invention shown schematically in FIG. 1, parallel with the high pressure liquid working stream, having parameters as at point 60, the lean stream, with parameters as at point 70, enters the portion of the system at which the lean stream is preheated. Prior to entering that portion of the system, the lean stream exiting from distillation tower 225, which has parameters as at point 39, is pumped to an intermediate pressure by pump 222, producing the lean stream having parameters as at point 70.

The lean stream is then split at stream separator 234 into first and second substreams, with parameters as at points 72 and 73, respectively. The streams with parameters as at points 72 and 73 pass through heat exchangers 214 and 216, respectively, where they are heated, obtaining parameters as at points 74 and 75, respectively. The first and second substreams are recombined at stream mixer 243, obtaining parameters as at point 79. Thereafter, the lean stream is again split at stream separator 233 into third and fourth substreams, with parameters as at points 25 and 26, respectively. Those streams pass through heat exchangers 227 and 212 respectively, obtaining parameters as at points 85 and 86, respectively. Thereafter, the third and fourth substreams are recombined at stream mixer 247, obtaining parameters as at point 78. As described above, the lean stream at point 78 is combined with the first withdrawal stream at stream mixer 241 to form the above described composite stream.

Meanwhile, the high pressure liquid working stream, having parameters as at point 60, parallel with the lean stream, having parameters as at point 70, passes through heat exchanger 214. Within the heat exchanger 214, the stream is heated and obtains parameters as at point 61. Preferably, the high pressure liquid working stream starts to boil at point 61. A preferably partially evaporated stream leaves heat exchanger 214 with parameters as at point 63. That stream then enters heat exchanger 212, where it is further heated and evaporated, obtaining parameters as at point 62. The stream with parameters as at point 62 is preferably partially evaporated.

Thereafter, that stream is split into first, second, and third substreams at stream separators 237 and 257, forming streams with parameters as at points 69, 66 and 67, respectively. The first substream passes through heat exchanger 250. The second substream passes through heat exchanger 251. The third substream passes through heat exchanger 252. The substreams are completely evaporated as they pass through recuperative heat exchangers 250, 251, and 252.

After exiting the heat exchangers, the substreams obtain parameters as at points 92, 91 and 90, respectively. Thereafter, all three substreams are recombined at stream mixers 245 and 242, producing a gaseous working stream having parameters as at point 68. That gaseous working stream is split into three substreams by stream separators 232 and 258 to produce streams having parameters as at points 93, 94 and 95, respectively. Those three substreams are sent through recuperative super-heaters 209, 210 and 253, where they are superheated. The three streams exiting from heat exchangers 209, 210, and 253 have parameters as at points 98, 97 and 96, respectively. Thereafter, all three superheated gaseous working substreams are recombined at stream mixers 244 and 240 to produce the superheated gaseous working stream having parameters as at point 99, completing the working fluid cycle.

From the above description, and the schematic of FIG. 1, it is apparent that the lean stream and high pressure liquid working stream having parameters as at points 70 and 60, respectively, enter the evaporation portion of the cycle, and that the second composite stream and the spent stream, with parameters as at points 59 and 36, respectively, exit the evaporation portion of the cycle.

The heating of the partially evaporated working stream as it flows from point 62 is provided by recuperation of heat from the returning withdrawal and spent streams in heat exchangers 210, 251, 253, and 252. However, the returning withdrawal and spent streams are at a significantly lower pressure than the pressure of the oncoming partially evaporated working stream. Additional heating of that stream in heat exchangers 209 and 250 is needed to completely evaporate and superheat the partially evaporated working stream. In the cycle of the present invention, that heat is provided by an external heat source.

In the described embodiment of the present invention, the external heat source includes an auxiliary steam cycle. In the embodiment shown in FIG. 1, the auxiliary steam cycle includes a boiler 254, a gravity separator 220, a superheater 218, a turbine 255, a pump 239, and a stream mixer 249. In that auxiliary steam cycle, a stream of completely condensed water, with parameters as at point 84, is pumped to high pressure by pump 239, obtaining parameters as at point 87. Thereafter, the stream, with parameters as at point 87, is combined at stream mixer 249 with a stream of condensed water flowing from separator 220, which has parameters as at point 129. The combination creates a stream with parameters as at point 127. The stream with parameters as at point 127, which is preferably in a state of a subcooled liquid, passes through a boiler 254, where it is preferably partially evaporated, obtaining parameters as at point 128.

That stream is then sent into gravity separator 220, where steam is separated from water. As described above, the water, with parameters as at point 129, is combined at stream mixer 249 with the stream flowing from pump 239, which has parameters as at point 87. The vapor stream, with parameters as at point 130, enters superheater 218 where it is heated, obtaining parameters as at point 131. Thereafter, the vapor stream with parameters as at point 131 passes through steam turbine 255 where it expands, providing work output and obtaining parameters as at point 89.

The vapor stream, with parameters as at point 89, passes through heat exchanger 209 where it is cooled, providing heat to superheat the gaseous working stream flowing from point 93 to point 98. After exiting heat exchanger 209, the vapor stream obtains parameters as at point 88. The state of the vapor stream as at point 88 preferably corresponds to that of a saturated vapor. The vapor stream then passes through heat exchanger 250, where it completely condenses, providing heat to completely evaporate the partially evaporated working stream flowing from point 69 to point 92. After exiting heat exchanger 250, the condensed stream has parameters as at point 84, which corresponds to the state of a saturated liquid.

In the embodiment shown in FIG. 1, heat rejection from the auxiliary steam cycle is utilized in the main cycle to supplement recuperative heating. Although water is the preferred working fluid for use in the auxiliary steam cycle, any fluid having favorable thermodynamic characteristics and solubility may be used as the working fluid for the auxiliary steam cycle.

In order to further illustrate the advantages that can be obtained by the present invention, a set of calculations was performed, as shown in Table II. This set of calculations is related to an illustrative power cycle in accordance with the system shown in FIG. 1. In this illustrative cycle, the working fluid is a water-ammonia mixture with a concentration of 75 wt. % of ammonia (weight of ammonia to total weight of the mixture). The parameters for the theoretical calculations of Table II are set forth in Table I below. In Table I the points set forth in the first column correspond to points set forth in FIG. 1.

TABLE I

| Point | P(psia) | X | T °F. | H <Btu/lb> | G |
|---|---|---|---|---|---|
| 14 | 75.90 | 0.7500 | 60.00 | −40.61 | 1.0000 |
| 21 | 2490.00 | 0.7500 | 60.00 | −30.25 | 1.0000 |
| 22 | 2480.00 | 0.7500 | 137.48 | 55.13 | 1.0000 |
| 23 | — | WATER | 52.00 | — | 10.2345 |
| 24 | — | WATER | 85.42 | — | 10.2345 |
| 25 | 846.83 | 0.1581 | 386.65 | 324.85 | .3034 |
| 26 | 846.83 | 0.1581 | 386.65 | 342.85 | .3768 |
| 29 | 76.20 | 0.7500 | 111.99 | 301.38 | 1.0000 |
| 30 | 276.00 | 0.7500 | 820.33 | 1123.64 | .6065 |
| 31 | 256.00 | 0.7500 | 1050.00 | 1277.21 | .6065 |
| 32 | 84.50 | 0.7500 | 823.04 | 1127.79 | .6065 |
| 33 | 82.00 | 0.7500 | 473.99 | 915.10 | .6065 |
| 34 | 80.50 | 0.7500 | 424.19 | 885.84 | .6065 |
| 35 | 79.00 | 0.7500 | 398.65 | 870.95 | .6065 |
| 36 | 77.50 | 0.7500 | 242.27 | 780.46 | .6065 |
| 37 | 76.50 | 0.9752 | 142.48 | 609.59 | .6248 |
| 38 | 76.50 | 0.7500 | 142.48 | 386.76 | 1.0000 |
| 39 | 77.50 | 0.1581 | 231.02 | 153.00 | .6802 |

TABLE I-continued

| Point | P(psia) | X | T °F. | H <Btu/lb> | G |
|---|---|---|---|---|---|
| 40 | 834.83 | 0.3750 | 236.02 | 120.47 | 1.0602 |
| 41 | 824.83 | 0.3750 | 142.48 | 18.26 | 1.0602 |
| 43 | 76.50 | 0.3750 | 142.48 | 15.64 | 1.0602 |
| 44 | 76.50 | 0.3750 | 142.48 | 15.64 | .6851 |
| 45 | 76.50 | 0.3750 | 142.48 | 15.64 | .3752 |
| 46 | 834.83 | 0.3750 | 236.02 | 120.47 | .0135 |
| 47 | 77.20 | 0.3750 | 169.17 | 120.47 | .0135 |
| 48 | 841.83 | 0.1581 | 373.86 | 310.22 | .3240 |
| 50 | 838.33 | 0.7500 | 473.99 | 872.06 | .3935 |
| 51 | 836.83 | 0.7500 | 424.19 | 830.81 | .3935 |
| 53 | 836.83 | 0.7500 | 424.19 | 830.81 | .2299 |
| 54 | 836.83 | 0.7500 | 424.19 | 830.81 | .1636 |
| 55 | 836.83 | 0.2729 | 423.02 | 446.94 | .8438 |
| 56 | 835.83 | 0.2729 | 391.65 | 313.05 | .8438 |
| 57 | 835.83 | 0.3750 | 391.65 | 423.91 | 1.0737 |
| 58 | 835.33 | 0.3750 | 378.86 | 371.50 | 1.0737 |
| 59 | 834.83 | 0.3750 | 236.02 | 120.47 | 1.0737 |
| 60 | 2475.00 | 0.7500 | 231.02 | 164.20 | 1.0000 |
| 61 | 2465.00 | 0.7500 | 373.86 | 378.59 | 1.0000 |
| 62 | 2455.00 | 0.7500 | 412.19 | 531.28 | 1.0000 |
| 63 | 2460.00 | 0.7500 | 385.33 | 429.53 | 1.0000 |
| 64 | 840.33 | 0.7500 | 822.62 | 1117.91 | .3935 |
| 65 | 840.33 | 0.7500 | 822.62 | 1117.91 | .6065 |
| 66 | 2455.00 | 0.7500 | 412.19 | 531.28 | .0814 |
| 67 | 2455.00 | 0.7500 | 412.19 | 531.28 | .0890 |
| 68 | 2440.00 | 0.7500 | 461.99 | 730.77 | 1.0000 |
| 69 | 2455.00 | 0.7500 | 412.19 | 531.28 | .8297 |
| 70 | 856.83 | 0.1581 | 231.02 | 155.46 | .6802 |
| 71 | 841.83 | 0.1581 | 373.86 | 310.22 | .3562 |
| 72 | 856.83 | 0.1581 | 231.02 | 155.46 | .3562 |
| 73 | 856.83 | 0.1581 | 231.02 | 155.46 | .3240 |
| 74 | 846.83 | 0.1581 | 386.65 | 324.85 | .3562 |
| 75 | 846.83 | 0.1581 | 386.65 | 324.85 | .3240 |
| 78 | 836.83 | 0.1581 | 412.19 | 354.62 | .6802 |
| 79 | 846.83 | 0.1581 | 386.65 | 324.85 | .6802 |
| 80 | 78.50 | 0.7500 | 385.86 | 863.50 | .6065 |
| 84 | 533.80 | 0.0000 | 473.79 | 457.31 | .2215 |
| 85 | 836.83 | 0.1581 | 412.19 | 354.62 | .3034 |
| 86 | 836.83 | 0.1581 | 412.19 | 354.62 | .3768 |
| 87 | 2440.00 | 0.0000 | 473.79 | 462.96 | .2215 |
| 88 | 534.80 | 0.0000 | 473.99 | 1204.43 | .2215 |
| 89 | 536.80 | 0.0000 | 668.18 | 1338.06 | .2215 |
| 90 | 2440.00 | 0.7500 | 461.99 | 730.77 | .0890 |
| 91 | 2440.00 | 0.7500 | 461.99 | 730.77 | .0814 |
| 92 | 2440.00 | 0.7500 | 461.99 | 730.77 | .8297 |
| 93 | 2440.00 | 0.7500 | 461.99 | 730.77 | .3655 |
| 94 | 2440.00 | 0.7500 | 461.99 | 730.77 | .2719 |
| 95 | 2440.00 | 0.7500 | 461.99 | 730.77 | .3626 |
| 96 | 2430.00 | 0.7500 | 811.04 | 1086.52 | .3626 |
| 97 | 2430.00 | 0.7500 | 811.04 | 1086.52 | .2719 |
| 98 | 2430.00 | 0.7500 | 521.72 | 811.76 | .3655 |
| 99 | 2430.00 | 0.7500 | 684.69 | 986.10 | 1.0000 |
| 100 | 2415.00 | 0.7500 | 1050.00 | 1257.72 | 1.0000 |
| 127 | 2440.00 | 0.0000 | 634.29 | 669.32 | 1.1076 |
| 128 | 2430.00 | 0.0000 | 663.27 | 796.52 | 1.1076 |
| 129 | 2430.00 | 0.0000 | 663.27 | 720.91 | .8861 |
| 130 | 2430.00 | 0.0000 | 663.27 | 1098.96 | .2215 |
| 131 | 2415.00 | 0.0000 | 1050.00 | 1508.66 | .2215 |
| 132 | 840.33 | 0.7500 | 822.62 | 1117.91 | 1.0000 |
| 133 | 820.33 | 0.7500 | 1050.00 | 1272.64 | .6065 |

Table II provides the theoretical performance parameters for the cycle shown in FIG. 1 using the parameters of Table I at the corresponding points of FIG. 1.

TABLE II

Performance Parameters of the Proposed FIG. 1 System Per 1 lb. of Working Fluid at Turbine 202 and Turbine 255 Inlets

| | |
|---|---|
| Performance Summary | |
| Sum of Turbine Expansion Work | 358.61 Btu |
| Total Turbine Electrical Output | 349.64 Btu |
| Heat Acquisition | |
| Heat Input in Heat Exchangers 254 and 218 | 231.65 Btu |
| Heat Input in Heat Exchanger 201 | 271.62 Btu |
| Heat Input in Heat Exchanger 203 | 93.85 Btu |
| Heat Input in Heat Exchanger 205 | 93.15 Btu |
| Total Heat Input | 690.27 Btu |

TABLE II-continued

Performance Parameters of the Proposed FIG. 1 System Per 1 lb. of Working Fluid at Turbine 202 and Turbine 255 Inlets

| Pump Work | Heat Input Equivalent | Power |
|---|---|---|
| Pump 223 | 10.36 | 12.95 Btu |
| Pump 222 | 1.68 | 2.10 Btu |
| Pump 239 | 1.25 | 1.56 Btu |
| Pelton Wheel Work | | |
| | 2.81 | 2.25 Btu |
| Net Work | | 335.28 Btu |
| Turbine Heat Rate | | 7026.55 Btu/lb |
| Net Thermal Efficiency | | 48.57% |

The sample calculation shown in Table II shows that the FIG. 1 cycle, using the parameters shown in Table I, has an internal, or turbine, efficiency of 48.57% versus the 47.49% achieved by the cycle described in U.S. Pat. No. 4,732,005.

While the present invention has been described with respect to a single preferred embodiment, those skilled in the art will appreciate a number of variations and modifications of that embodiment. It is intended that the appended claims cover all such variations and modifications as fall within the true spirit and scope of the present invention.

What is claimed is:

1. A method for implementing a thermodynamic cycle comprising the steps of:
   - expanding a gaseous working stream to transform its energy into usable form;
   - removing from the expanded gaseous working stream a withdrawal stream;
   - combining the withdrawal stream with a lean stream, having a higher content of a higher-boiling component than is contained in the withdrawal stream, to form a composite stream;
   - condensing the composite stream to provide heat;
   - separating the composite stream to form a liquid stream, the liquid stream forming a portion of the lean stream that is combined with the withdrawal stream, and a vapor stream;
   - forming an oncoming liquid working stream that evaporates at a temperature lower than the temperature at which the composite stream condenses; and
   - evaporating the oncoming liquid working stream, using the heat produced by condensing the composite stream and heat provided by an external heat source, to form the gaseous working stream.

2. The method of claim 1 wherein the external heat source is an auxiliary steam cycle.

3. The method of claim 2 wherein the auxiliary steam cycle comprises:
   - expansion means for expanding a gaseous working steam to transform its energy into usable form;
   - a condenser for condensing the gaseous working stream to form a liquid working stream;
   - a pump for pumping the liquid working stream to a higher pressure than the pressure of the expanded gaseous working stream; and
   - an evaporator for evaporating the liquid working stream to form the gaseous working stream.

4. The method of claim 3 wherein the evaporator of the auxiliary steam cycle partially evaporates the liquid working stream after the liquid working stream has been pumped to a higher pressure; and wherein the auxiliary steam cycle further comprises a separator for separating the partially evaporated stream to form a vapor stream, the vapor stream forming the gaseous working stream, and a liquid stream.

5. The method of claim 4 wherein the auxiliary steam cycle further comprises:

a superheater for superheating the vapor stream after the vapor stream has been separated from the partially evaporated stream; and a stream mixer for combining the liquid stream with the liquid working stream after the liquid working stream has been pumped to a higher pressure.

6. The method of claim 1 further including removing a spent stream from the gaseous working stream and combining the spent stream with the composite stream.

7. The method of claim 6 wherein the composite stream is sent into a distillation tower, at which the composite stream is combined with the spent stream, prior to the composite stream being separated into the liquid stream and vapor stream.

8. The method of claim 7 wherein the composite stream is divided into a first stream and a second stream, after the composite stream has been condensed; and wherein the first stream is sent into the top of the distillation tower and the second stream is sent into the middle section of the distillation tower.

9. The method of claim 8 wherein the first stream is divided into a third stream and a fourth stream, after the first stream has been formed; and wherein the third stream is sent into the top of the distillation tower and the fourth stream is combined with the vapor stream to form a pre-condensed working stream.

10. The method of claim 1 wherein the vapor stream is condensed to form the oncoming liquid working stream.

11. The method of claim 9 wherein the pre-condensed working stream is condensed to form the oncoming liquid working stream.

12. The method of claim 6 wherein the spent stream is expanded to transform its energy into usable form prior to combining the spent stream with the composite stream, the composite stream is expanded to a reduced pressure prior to being combined with the spent stream, the gaseous working stream, prior to being expanded, exchanges heat with the withdrawal stream and exchanges heat with the spent stream; the composite stream, prior to being expanded, exchanges heat with the lean stream and the liquid working stream, the spent stream, prior to combining with the composite stream, exchanges heat with a portion of the gaseous working stream, and exchanges heat with a portion of the lean stream, the lean stream is pumped to a higher pressure than the pressure of the liquid stream formed from the separation of the composite stream, and wherein the lean stream, after being pumped to a higher pressure, exchanges heat with the composite stream and the spent stream prior to combining with the withdrawal stream to form the composite stream, and wherein the liquid working stream is pumped to a higher pressure than the pressure of the liquid working stream when first formed, and wherein the resulting high pressure liquid working stream exchanges heat with the composite stream, the withdrawal stream, the spent stream, and the external heat source until the heat transferred from the composite, withdrawal, and spent streams, and from the external heat source to the liquid working stream evaporates the liquid working stream to form the gaseous working stream.

13. A method for implementing a thermodynamic cycle comprising the steps of:

superheating a gaseous working stream;

expanding the superheated gaseous working stream to transform its energy into usable form;

dividing the expanded gaseous working stream into a withdrawal stream and a spent stream;

reheating the spent stream and expanding the reheated spent stream;

cooling the withdrawal stream and the spent stream, after the expansion of the spent stream, the cooling of the withdrawal stream and the spent stream transferring heat used to superheat the gaseous working stream;

combining the withdrawal stream with a lean stream, having a higher content of a high-boiling component than the withdrawal stream, to form a composite stream that condenses over a temperature range that is higher than the temperature range required to evaporate a high pressure liquid working stream;

condensing the composite stream to provide heat to partially evaporate the high pressure liquid working stream to form a partially evaporated working stream, and to provide heat to the lean stream;

cooling and condensing the composite stream to preheat the high pressure liquid working stream;

expanding the composite stream to reduce the pressure of the composite stream;

dividing the composite stream into a first stream and a second stream;

separating the first stream to form a liquid stream, that produces the lean stream, and a vapor stream;

combining the vapor stream with the second stream to form a pre-condensed working stream;

condensing the pre-condensed working stream to produce a liquid working stream;

pumping the lean stream to a higher pressure than the pressure of the liquid stream produced from the separation of the first stream;

preheating the high pressure lean stream with a counterstream of the composite stream, formed by combining the lean stream with the withdrawal stream, and a counterstream of the spent stream;

pumping the liquid working stream, formed from the condensation of the pre-condensed working stream, to a higher pressure, forming the high pressure liquid working stream;

heating the high pressure liquid working stream with heat transferred from a counterstream of the composite stream to form the partially evaporated working stream; and evaporating the partially evaporated working stream with heat transferred from the withdrawal and spent streams, and from an external heat source, producing the gaseous working stream.

14. The method of claim 13 further including dividing the withdrawal stream into a first withdrawal stream and a second withdrawal stream, combining the first withdrawal stream with the lean stream to form a first composite stream for providing heat to partially evaporate the high pressure liquid working stream, and combining the first composite stream with the second withdrawal stream, after the first composite stream has provided heat to partially evaporate the high pressure liquid working stream, to form the composite stream that is used to preheat the high pressure liquid working stream.

15. The method of claim 13 wherein heat from the spent stream is used to evaporate a portion of the partially evaporated working stream, and to preheat the lean stream, after heat from the spent stream has been used to superheat the gaseous working stream.

16. A method for implementing a thermodynamic cycle comprising the steps of:

superheating a gaseous working stream;

expanding the superheated gaseous working stream to transform its energy into usable form;

dividing the expanded gaseous working stream into a withdrawal stream and a spent stream;

reheating the spent stream and expanding the reheated spent stream;

cooling the withdrawal stream and the spent stream, after the expansion of the spent stream, the cooling of the withdrawal stream and the spent stream transferring heat used to superheat the gaseous working stream;

combining the withdrawal stream with a lean stream, having a higher content of a high-boiling component than the withdrawal stream, to form a composite stream that condenses over a temperature range that is higher than the temperature range required to evaporate a high pressure liquid working stream;

condensing the composite stream to provide heat to partially evaporate the high pressure liquid working stream to form a partially evaporated working stream;

cooling and condensing the composite stream to heat the lean stream and to preheat the high pressure liquid working stream;

evaporating and superheating a portion of the partially evaporated working stream with heat from the spent and withdrawal streams;

preheating the lean stream with heat from the spent stream;

dividing the composite stream into a first stream and a second stream after the composite stream has been used to preheat the high pressure liquid working stream;

expanding the first stream to reduce the pressure of the first stream;

dividing the first stream into a third stream and a fourth stream, after the first stream has been expanded;

sending the second stream and the third stream into a distillation tower;

sending the spent stream into the distillation tower, after the spent stream has been used to preheat the lean stream;

separating from the second stream, the third stream and the spent stream, that have been sent into the distillation tower, a liquid stream, that forms the lean stream, and a vapor stream;

combining the vapor stream with the fourth stream to produce a pre-condensed working stream, condensing the pre-condensed working stream to produce a liquid working stream;

pumping the lean stream to a higher pressure than the pressure of the liquid stream that is produced from the distillation tower;

heating the lean stream, after it has been pumped to a higher pressure, with heat from a counterstream of the composite stream, that is formed by combining the lean stream with the withdrawal stream, and a counterstream of the spent stream;

pumping the liquid working stream, formed by the condensation of the pre-condensed working stream, to a higher pressure to form the high pressure liquid working stream;

heating the high pressure liquid working stream with heat transferred from a counterstream of the composite stream to form the partially evaporated working stream; and evaporating the partially evaporated working stream with heat transferred from the withdrawal and spent streams, and from an external heat source, producing the gaseous working stream.

17. Apparatus for implementing a thermodynamic cycle comprising:

means for expanding a gaseous working stream to transform its energy into usable form;

means for removing from the expanded gaseous working stream a withdrawal stream;

a first stream mixer for combining the withdrawal stream with a lean stream, having a higher content of a higher-boiling component than is contained in the withdrawal stream, to form a composite stream that condenses over a temperature range that is higher than the temperature range required to evaporate an oncoming liquid working stream;

a heat exchanger for condensing the composite stream to provide heat to partially evaporate the oncoming liquid working stream;

a distillation tower for separating the composite stream to form a liquid stream, the liquid stream forming a portion of the lean stream that is combined with the withdrawal stream, and a vapor stream;

a condenser for forming the oncoming liquid working stream that is partially evaporated by the composite stream in the heat exchanger; and an external heat source for evaporating the oncoming liquid working stream, using heat provided by the external heat source, to form the gaseous working stream.

18. The apparatus of claim 17 wherein the external heat source is an auxiliary steam cycle.

19. The apparatus of claim 18 wherein the auxiliary steam cycle comprises:

means for expanding a gaseous working stream to transform its energy into usable form;

a condenser for condensing the gaseous working stream to form a liquid working stream;

a pump for pumping the liquid working stream to a higher pressure than the pressure of the expanded gaseous working stream;

a heat exchanger for evaporating the liquid working stream to form the gaseous working stream.

20. The apparatus of claim 19 wherein the auxiliary steam cycle further comprises:

means for partially evaporating the liquid working stream after the liquid working stream has been pumped to a higher pressure; and means for separating the partially evaporated stream to form a vapor stream, the vapor stream forming the gaseous working stream, and a liquid stream.

21. The apparatus of claim 20 wherein the auxiliary steam cycle further comprises:

a second heat exchanger for superheating the vapor stream after the vapor stream has been separated from the partially evaporated stream;

a steam mixer for combining the liquid stream with the liquid working stream after the liquid working stream has been pumped to a higher pressure.

22. The apparatus of claim 17 further including means for removing a spent stream from the gaseous working stream and means for combining the spent stream with the composite stream.

23. The apparatus of claim 22 further comprising means for dividing the composite stream into a first stream and a second stream, after the composite stream has been condensed; and means for sending the first stream into the top of the distillation tower and the second stream into the middle section of the distillation tower.

24. The apparatus of claim 23 further comprising means for dividing the first stream into a third stream and a fourth stream, after the first stream has been formed; and means for sending the third stream into the top of the distillation tower and means for combining the fourth stream with the vapor stream to form a pre-condensed working stream.

25. The apparatus of claim 17 further comprising means for sending the vapor stream to the condenser to enable the condenser to condense the vapor stream to form the oncoming liquid working stream.

26. The apparatus of claim 24 further comprising means for sending the pre-condensed working stream to the condenser to enable the condenser to condense the pre-condensed working stream to form the oncoming liquid working stream.

27. The apparatus of claim 22 further comprising means for expanding the spent stream to transform its energy into usable form prior to combining the spent stream with the composite stream;

means for expanding the composite stream to a reduced pressure prior to being separated;

heat exchanging means for enabling the gaseous working stream, prior to being expanded, to exchange heat with the withdrawal stream and to exchange heat with the spent stream;

heat exchanging means for enabling the composite stream, prior to being expanded, to exchange heat with the lean stream and the liquid working stream;

heat exchanging means for enabling the spent stream, prior to combining with the composite stream, to exchange heat with a portion of the gaseous working stream, and to exchange heat with a portion of the lean stream;

a pump for pumping the lean stream to a higher pressure than the pressure of the liquid stream formed from the separation of the composite stream, heat exchanging means for enabling the lean stream, after being pumped to a higher pressure, to exchange heat with the composite stream prior to combining with the withdrawal stream to form the composite stream; a pump for pumping the liquid working stream to a higher pressure than the pressure of the liquid working stream when first formed; heat exchanging means for enabling the high pressure liquid working stream to exchange heat with the composite, withdrawal, and spent streams, and the external heat source until the heat transferred from the composite, withdrawal, and spent streams, and from the external heat source, to the liquid working stream evaporates the liquid working stream to form the gaseous working stream.

28. Apparatus for implementing a thermodynamic cycle comprising:

means for superheating a gaseous working stream;

means for expanding the superheated gaseous working stream to transform its energy into usable form;

means for dividing the expanded gaseous working stream into a withdrawal stream and a spent stream;

means for reheating the spent stream and expanding the reheated spent stream;

means for cooling the withdrawal stream and the spent stream, after the expansion of the spent stream, such that the cooling of the withdrawal stream and the spent stream transfers heat for superheating the gaseous working stream;

means for combining the withdrawal stream with a lean stream, having a higher content of a high-boiling component than the withdrawal stream, to form a composite stream that condenses over a temperature range that is higher than the temperature range required to evaporate an oncoming liquid working stream;

means for condensing the composite stream to provide heat to partially evaporate the oncoming liquid working stream to form a partially evaporated working stream, and to provide heat to the lean stream;

means for cooling and condensing the composite stream to preheat the oncoming liquid working stream;

means for expanding the composite stream to reduce the pressure of the composite stream;

means for dividing the composite stream into a first stream and a second stream;

means for separating the first stream to form a liquid stream, that produces the lean stream, and a vapor stream;

means for combining the vapor stream with the second stream to form a pre-condensed working stream;

means for condensing that pre-condensed working stream to produce the liquid working stream;

a first pump for pumping the lean stream to a higher pressure than the pressure of the liquid stream produced from the separation of the first stream;

means for heating the high pressure lean stream with a counterstream of the composite stream, formed by combining the lean stream with the withdrawal stream, and a counterstream of the spent stream;

a second pump for pumping the liquid working stream, formed from the condensation of the pre-condensed working stream, to a higher pressure, forming a high pressure liquid working stream;

means for heating the high pressure liquid working stream with heat transferred from a counterstream of the composite stream to form a partially evaporated working stream; and means for evaporating the partially evaporated working stream with heat transferred from the withdrawal and spent streams, and from an external heat source, producing the gaseous working stream.

29. The apparatus of claim 28 further comprising means for dividing the withdrawal stream into a first withdrawal stream and a second withdrawal stream, means for combining the first withdrawal stream with the lean stream to form a first composite stream for providing heat to partially evaporate the high pressure liquid working stream, and means for combining the first composite stream with the second withdrawal stream, after the first composite stream has provided heat to partially evaporate the high pressure liquid working stream, to form the composite stream that is used to preheat the high pressure liquid working stream.

30. The apparatus of claim 28 further comprising means for enabling heat from the spent stream to be used to evaporate a portion of the liquid working stream, after heat from the spent stream has been used to superheat the gaseous working stream, and to preheat the lean stream.

31. Apparatus for implementing a thermodynamic cycle comprising:

means for superheating a gaseous working stream;

means for expanding the superheated gaseous working stream to transform its energy into usable form;

means for dividing the expanded gaseous working stream into a withdrawal stream and a spent stream;

means for reheating the spent stream and expanding the reheated spent stream;

means for cooling the withdrawal stream and the spent stream, after the expansion of the spent stream, such that the cooling of the withdrawal stream and the spent stream transfers heat for superheating the gaseous working stream;

means for combining the withdrawal stream with a lean stream, having a higher content of a high-boiling component than the withdrawal stream, to form a composite stream that condenses over a temperature range that is higher than the temperature range required to evaporate a high pressure liquid working stream;

means for condensing the composite stream to provide heat to partially evaporate the high pressure liquid working stream to form a partially evaporated working stream;

means for cooling and condensing the composite stream to heat the lean stream and to preheat the high pressure liquid working stream;

means for evaporating and superheating a portion of the partially evaporated working stream with heat from the spent and withdrawal streams;

preheating the lean stream with heat from the spent stream;

means for dividing the composite stream into a first stream and a second stream after the composite stream has been used to preheat the high pressure liquid working stream;

means for expanding the first stream to reduce the pressure of the first stream;

means for dividing the first stream into a third stream and a fourth stream, after the first stream has been expanded;

means for sending the second stream and the third stream into a distillation tower;

means for sending the spent stream into the distillation tower, after the spent stream has been used to preheat the lean stream;

means for separating from the second stream, the third stream and the spent stream, that have been sent into the distillation tower, a liquid stream, that forms the lean stream, and a vapor stream;

means for combining the vapor stream with the fourth stream to produce a pre-condensed working stream;

means for condensing the pre-condensed working stream to produce a liquid working stream;

a first pump for pumping the lean stream to a higher pressure than the pressure of the liquid stream that is produced from the distillation tower;

means for heating the lean stream, after it has been pumped to a higher pressure, with heat from a counterstream of the composite stream, that is formed by combining the lean stream with the withdrawal stream, and a counterstream of the spent stream;

a second pump for pumping the liquid working stream, formed by the condensation of the pre-condensed working stream, to a higher pressure to form the high pressure liquid working stream;

means for heating the high pressure liquid working stream with heat transferred from a counterstream of the composite stream to form the partially evaporated working stream; and means for evaporating the partially evaporated working stream with heat transferred from the withdrawal and spent streams, and from an external heat source, producing the gaseous working stream.

* * * * *